US011607768B2

(12) United States Patent
Shin et al.

(10) Patent No.: US 11,607,768 B2
(45) Date of Patent: Mar. 21, 2023

(54) APPARATUS AND METHOD FOR CHEMICAL MECHANICAL POLISHING

(71) Applicant: SAMSUNG ELECTRONICS CO., LTD., Suwon-si (KR)

(72) Inventors: Ilcheol Shin, Seoul (KR); Sung-Chang Park, Hwaseong-si (KR); Kyoungwoo Kim, Seongnam-si (KR); Young-Kyun Woo, Osan-si (KR); Hak-Jae Im, Osan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 792 days.

(21) Appl. No.: 16/515,257

(22) Filed: Jul. 18, 2019

(65) Prior Publication Data

US 2020/0198088 A1 Jun. 25, 2020

(30) Foreign Application Priority Data

Dec. 20, 2018 (KR) ..... 10-2018-0166636

(51) Int. Cl.
*B24B 37/005* (2012.01)
*B24B 57/02* (2006.01)
*B24B 37/34* (2012.01)

(52) U.S. Cl.
CPC ..... *B24B 37/005* (2013.01); *B24B 37/34* (2013.01); *B24B 57/02* (2013.01)

(58) Field of Classification Search
CPC ..... B24B 37/005; B24B 37/34; B24B 57/02
USPC ..... 451/5, 41, 84, 11
See application file for complete search history.

(56) References Cited

U.S. PATENT DOCUMENTS

| | | | | |
|---|---|---|---|---|
| 6,119,294 | A | 9/2000 | Lai et al. | |
| 6,269,510 | B1 | 8/2001 | Beardsley et al. | |
| 7,685,667 | B2 | 3/2010 | Lin et al. | |
| 2001/0024691 | A1* | 9/2001 | Kimura | C25D 7/123 156/345.31 |
| 2003/0111095 | A1* | 6/2003 | Sugarman | H01L 21/67046 15/21.1 |
| 2008/0314870 | A1* | 12/2008 | Inoue | B08B 1/04 118/58 |
| 2012/0160267 | A1* | 6/2012 | Kodera | H01L 21/67046 15/21.1 |
| 2014/0310895 | A1 | 10/2014 | Chen | |
| 2017/0053794 | A1* | 2/2017 | Kim | H01L 21/67046 |

FOREIGN PATENT DOCUMENTS

| | | | |
|---|---|---|---|
| JP | 2002-280348 | A | 9/2002 |
| JP | 2012-138498 | A | 7/2012 |
| KR | 10-0616488 | B1 | 8/2006 |
| KR | 10-0744263 | B1 | 7/2007 |
| KR | 10-1399840 | B1 | 5/2014 |
| KR | 10-2017-0087766 | A | 7/2017 |

* cited by examiner

*Primary Examiner* — Joseph J Hail
*Assistant Examiner* — Shantese L McDonald
(74) *Attorney, Agent, or Firm* — Sughrue Mion, PLLC

(57) ABSTRACT

A chemical mechanical polishing apparatus includes a cleaning unit that cleans a substrate, a brushing unit that includes a plurality of roll brushes brushing the substrate and a driver driving the roll brushes, and a controlling unit that controls the driver. The controlling unit includes a time calculator that counts a usage time of the roll brushes, and a drive controller that reduces a distance between the roll brushes, based on the usage time of the roll brushes.

19 Claims, 7 Drawing Sheets

APPARATUS AND METHOD FOR CHEMICAL MECHANICAL POLISHING

CROSS-REFERENCE TO RELATED APPLICATION

This application is based on and claims priority under 35 U.S.C. § 119 to Korean Patent Application No. 10-2018-0166636 filed on Dec. 20, 2018 in the Korean Intellectual Property Office, the entire contents of which are incorporated by reference herein.

BACKGROUND

The present disclosure relates to an apparatus for and a method of fabricating semiconductor devices, and more particularly, to an apparatus and method for chemical mechanical polishing for planarization of a substrate.

In general, semiconductor devices are fabricated by applying a plurality of unit processes. The unit processes may include a deposition process, a diffusion process, a thermal process, a photolithography process, a polishing process, an etching process, an ion implantation process, and a cleaning process. The polishing process is a process to planarize a dielectric or metal layer on a substrate. The polishing process may be followed by the cleaning process. The cleaning process may be a process to remove any slurry compound on the surface of a substrate that was used during the polishing process.

SUMMARY

Example embodiments of the present disclosure provide chemical mechanical polishing apparatus and method capable of increasing lifetime of a brush.

Example embodiments of the present disclosure provide chemical mechanical polishing apparatus and method capable of minimizing defects.

In accordance with an aspect of the disclosure, a chemical mechanical polishing (CMP) apparatus includes a cleaning unit configured to clean a substrate; a brushing unit comprising a plurality of roll brushes configured to brush the substrate and a driver configured to drive the plurality of roll brushes; and a controlling unit configured to control the driver, wherein the controlling unit is configured to count a usage time of the plurality of roll brushes and to reduce a distance between the plurality of roll brushes based on the counted using time.

The brushing unit may further include a cleaning solution nozzle configured to provide a cleaning solution between the plurality of roll brushes, and the controlling unit may be further configured to temporarily increase a flow rate of the cleaning solution at an initial use of the plurality of roll brushes.

The CMP apparatus may further include a polishing pad configured to polish the substrate; a slurry nozzle located on the polishing pad; and a slurry supply configured to provide the polishing pad with a first slurry or a second slurry through the slurry nozzle, and the controlling unit may be further configured to reduce the distance between the plurality of roll brushes at a first rate in response to the first slurry being provided and at a second rate in response to the second slurry being provided.

The first slurry may include silica, the second slurry may include hydrogen peroxide, and the first rate may be greater than the second rate.

The first rate may be 1 mm/day.

The second rate may be 0.1 mm/day.

The controlling unit may be further configured to compress the plurality of roll brushes by periodically reducing the distance between the plurality of roll brushes by an additional distance and subsequently increasing the distance between the plurality of roll brushes by the additional distance.

The plurality of roll brushes may be compressed once every predetermined time period, and the additional distance may be 6 mm.

The slurry supply may include a first slurry tank configured to store the first slurry; a second slurry tank configured to store the second slurry; a first valve located between the first slurry tank and the slurry nozzle configured to be selectively opened; and a second valve located between the second slurry tank and the slurry nozzle configured to be selectively opened, the controlling unit may be further configured to reduce the distance between the plurality of roll brushes at the first rate when the first valve is opened, and the controlling unit may be further configured to reduce the distance between the plurality of roll brushes at the second rate when the second valve is opened.

The driver may include a spring configured to push the plurality of roll brushes away from each other; and a push pin configured to push one of the plurality of roll brushes to reduce the distance between the plurality of roll brushes.

In accordance with an aspect of the disclosure, a chemical mechanical polishing (CMP) apparatus includes a load station accommodating a carrier, the carrier being configured to store a substrate; a polishing module configured to provide a first slurry or a second slurry to polish the substrate; a cleaning module comprising a plurality of roll brushes configured to brush the first slurry or the second slurry remaining on the polished substrate; and a controlling unit configured to determine whether to supply the first slurry or the second slurry based on a polishing target on the substrate and to determine a rate of reduction in distance between the plurality of roll brushes based on the determination whether to supply the first slurry or the second slurry.

The controlling unit may be further configured to reduce the distance between the plurality of roll brushes at a first rate when the first slurry is provided on the substrate, and the controlling unit may be further configured to reduce the distance between the plurality of roll brushes at a second rate less than the first rate when the second slurry is provided on the substrate.

The first rate may be 1 mm/day, and the second rate may be 0.1 mm/day.

The cleaning module may further include a driver configured to adjust the distance between the plurality of roll brushes, and the controlling unit may be further configured to count a usage time of the plurality of roll brushes and to control the driver to reduce the distance between the plurality of roll brushes at the first rate or the second rate based on the counted usage time.

The CMP apparatus may further include a first valve configured to be selectively opened to supply the first slurry and a second valve configured to be selectively opened to supply the second slurry, and the controlling unit may be further configured to determine whether the first slurry or the second slurry is provided on the substrate based on whether the first valve or the second valve is opened.

In accordance with an aspect of the disclosure, a chemical mechanical polishing (CMP) method includes polishing a substrate with a first slurry or a second slurry; cleaning the substrate; brushing the substrate with a plurality of roll brushes; and rinsing the substrate, wherein the brushing the substrate includes reducing a distance between the plurality of roll brushes based on a usage time of the plurality of roll brushes.

The brushing the substrate may further include determining whether the first slurry is provided on the substrate; and reducing the distance between the plurality of roll brushes at a first rate when it is determined that the first slurry is provided, wherein the first slurry includes silica or ceria.

The brushing the substrate may further include reducing the distance between the plurality of roll brushes at a second rate less than the first rate when it is determined that the substrate is provided with the second slurry different from the first slurry, wherein the second slurry includes hydrogen peroxide.

The CMP method may further include periodically providing a bare substrate between the plurality of roll brushes when it is determined that the second slurry is provided; and reducing the distance between the plurality of roll brushes by an additional distance whenever the bare substrate is provided and subsequently increasing the distance between the plurality of roll brushes by the additional distance.

The CMP method may further include determining whether the second slurry is provided on the substrate; and temporarily increasing a flow rate of a cleaning solution provided between the plurality of roll brushes at an initial use of the plurality of roll brushes when it is determined that the second slurry is provided.

DETAILED DESCRIPTION OF EMBODIMENTS

Figure 1:
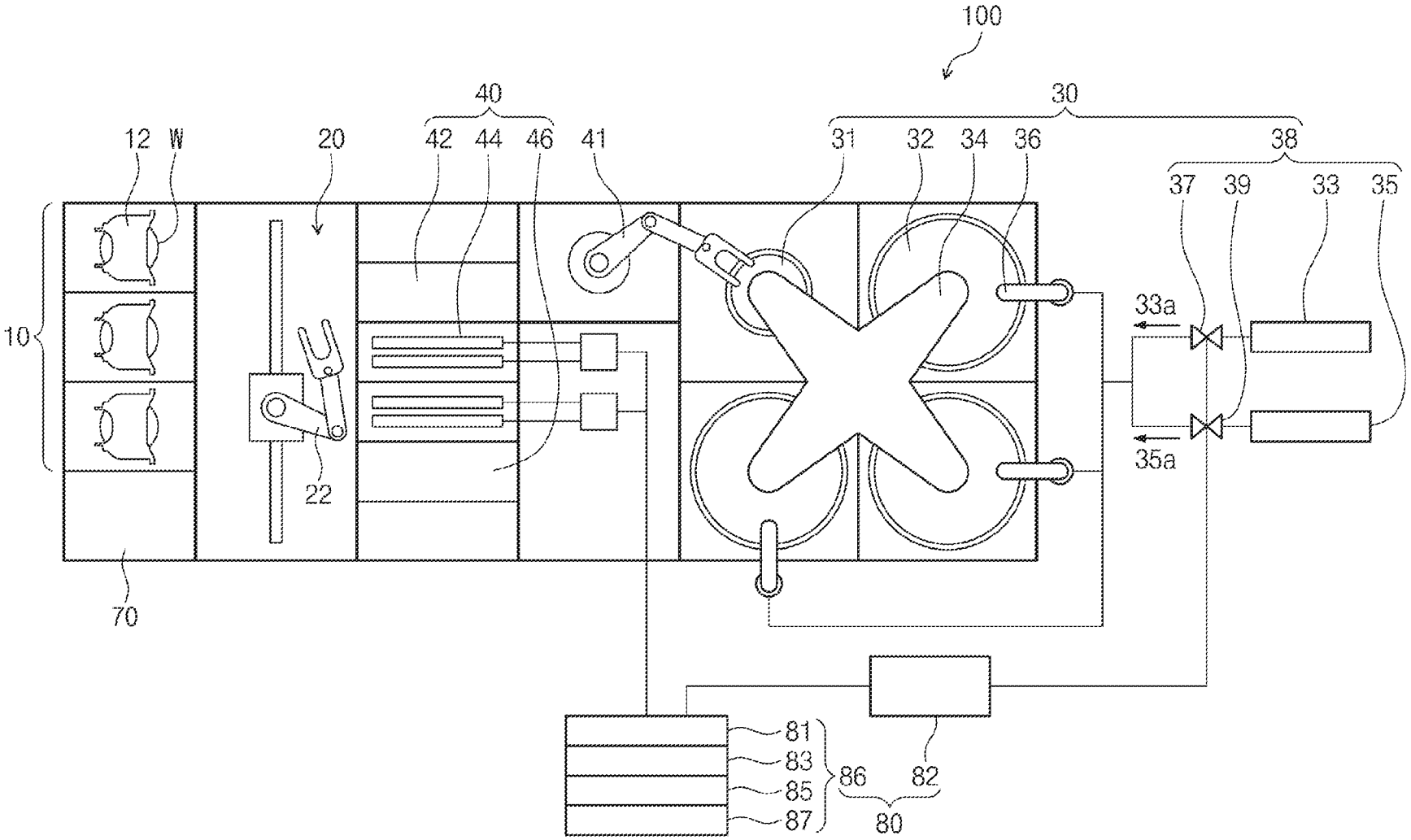
FIG. 1 illustrates a schematic diagram showing a chemical mechanical polishing apparatus according to an example embodiment.

FIG. 1 illustrates a chemical mechanical polishing (CMP) apparatus 100 according to an example embodiment.

Referring to FIG. 1, the CMP apparatus 100 may include a load station 10, an interface module 20, a polishing module 30, a cleaning module 40, a measuring module 70, and a controlling unit 80.

The load station 10 may accommodate at least one carrier 12. The carrier 12 may store at least one substrate W. The substrate W may include a silicon wafer.

The interface module 20 may be installed adjacent to the load station 10. The interface module 20 may have a first robot arm 22. The first robot arm 22 may bring the substrate W out of the carrier 12 and then provide the substrate W to the polishing module 30. The first robot arm 22 may transfer the substrate W to a second robot arm 41 to provide the substrate W to the polishing module 30 or may provide the substrate W to the polishing module 30 without using the second robot arm 41. In addition, the first robot arm 22 may transfer the substrate W from the cleaning module 40 to the carrier 12. The first robot arm 22 may also transfer the substrate W between the cleaning module 40 and the measuring module 70.

The second robot arm 41 may be provided between the interface module 20 and the polishing module 30. The second robot arm 41 may transfer the substrate W from the first robot arm 22 to the polishing module 30. The second robot arm 41 may also transfer the substrate W from the polishing module 30 to the cleaning module 40.

The polishing module 30 may polish the substrate W. For example, the polishing module 30 may include a load cup 31, a polishing pad 32, a polishing head 34, a slurry nozzle 36, and a slurry supply 38.

The load cup 31 may be placed adjacent to the second robot arm 41. The second robot arm 41 may provide the substrate W to the load cup 31. When a substrate W has been polished, the second robot arm 41 may provide the cleaning module 40 with the substrate W from the load cup 31.

The polishing pad 32 may be disposed adjacent to the load cup 31. The polishing pad 32 may polish the substrate W. For example, the polishing pad 32 may include a non-woven fabric. The substrate W may be sequentially provided onto a plurality of polishing pads 32. The plurality of polishing pads 32 may sequentially polish a single substrate W. Alternatively, the plurality of polishing pads 32 may individually polish a plurality of substrates W.

The polishing head 34 may transfer the substrate W between the polishing pad 32 and the load cup 31. For example, the polishing head 34 may vacuum-absorb the substrate W and transfer the absorbed substrate W to a plurality of polishing pads 32 and the load cup 31. The polishing head 34 may rotate the substrate W on the polishing pad 32. The substrate W may be polished by friction between the substrate W and the polishing pad 32.

The slurry nozzle 36 may be positioned on a portion of the polishing pad 32. The slurry nozzle 36 may be associated with the slurry supply 38. The slurry nozzle 36 may provide the polishing pad 32 with a first slurry 33*a* or a second slurry 35*a*. The first slurry 33*a* and the second slurry 35*a* may assist or accelerate polishing of the substrate W. The first slurry 33*a* may be an abrasive to polish dielectric layers (e.g., silicon oxide or silicon nitride). For example, the first slurry 33*a* may include silica or ceria. The second slurry 35*a* may be an abrasive to polish metal layers (e.g., Cu). For example, the second slurry 35*a* may include hydrogen peroxide or aqueous ammonia.

The slurry supply 38 may supply the first slurry 33*a* and second slurry 35*a* to the polishing pad 32. For example, the slurry supply 38 may include a first slurry tank 33 that stores the first slurry 33*a*, a second slurry tank 35 that stores the slurry 35*a*, a first valve 37, and a second valve 39. The first valve 37 may be installed between the first slurry tank 33 and the slurry nozzle 36 and may control supply of the first slurry 33*a*. The second valve 39 may be installed between the second slurry tank 35 and the slurry nozzle 36 and may control supply of the second slurry 35*a*.

The cleaning module 40 may be disposed between the second robot arm 41 and the interface module 20. The cleaning module 40 may clean the substrate W. The cleaning module 40 may remove the first slurry 33*a* and the second slurry 35*a* from the substrate W after the substrate has been polished by the polishing module 30. For example, the cleaning module 40 may include a chemical cleaning unit 42, a brushing unit 44, and a rinsing unit 46. The chemical cleaning unit 42 may use a chemical etchant to clean the substrate W. The brushing unit 44 may be placed between the chemical cleaning unit 42 and the rinsing unit 46 and may brush the substrate W. The rinsing unit 46 may rinse the substrate W. After the substrate has been polished by the polishing module 30, the first robot arm 22 may transfer the substrate W to the chemical cleaning unit 42, the brushing unit 44, and the rinsing unit 46.

The chemical cleaning unit 42 may be placed between the second robot arm 41 and the brushing unit 44. For example, the chemical cleaning unit 42 may include a chemical bath. The substrate W may be immersed in a chemical (not shown) within the chemical bath. The chemical may wet-clean the substrate W.

Figure 2:
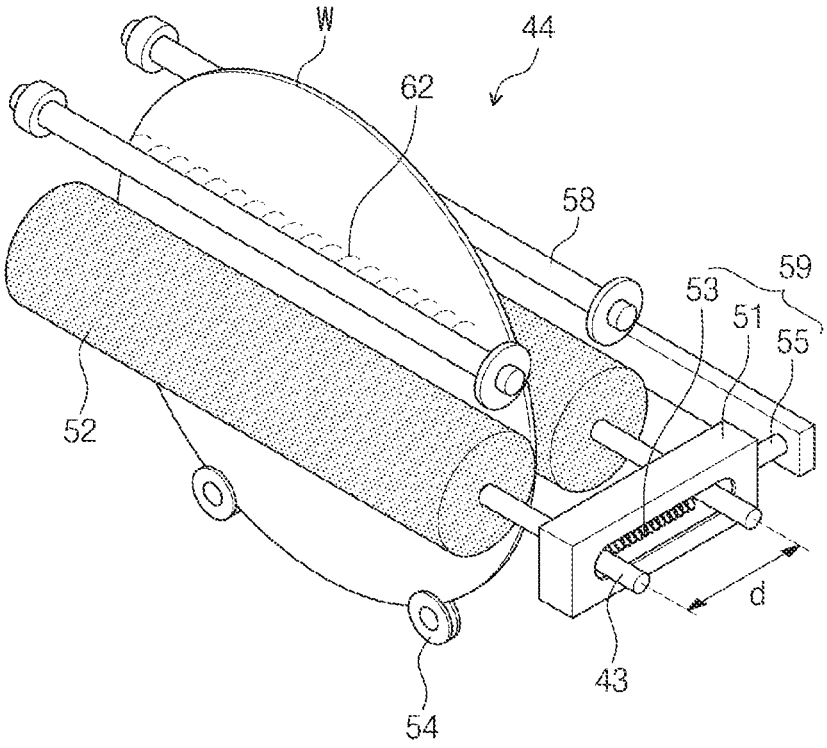
FIG. 2 illustrates a perspective view showing an example of a brushing unit shown in FIG. 1.
Figure 3:
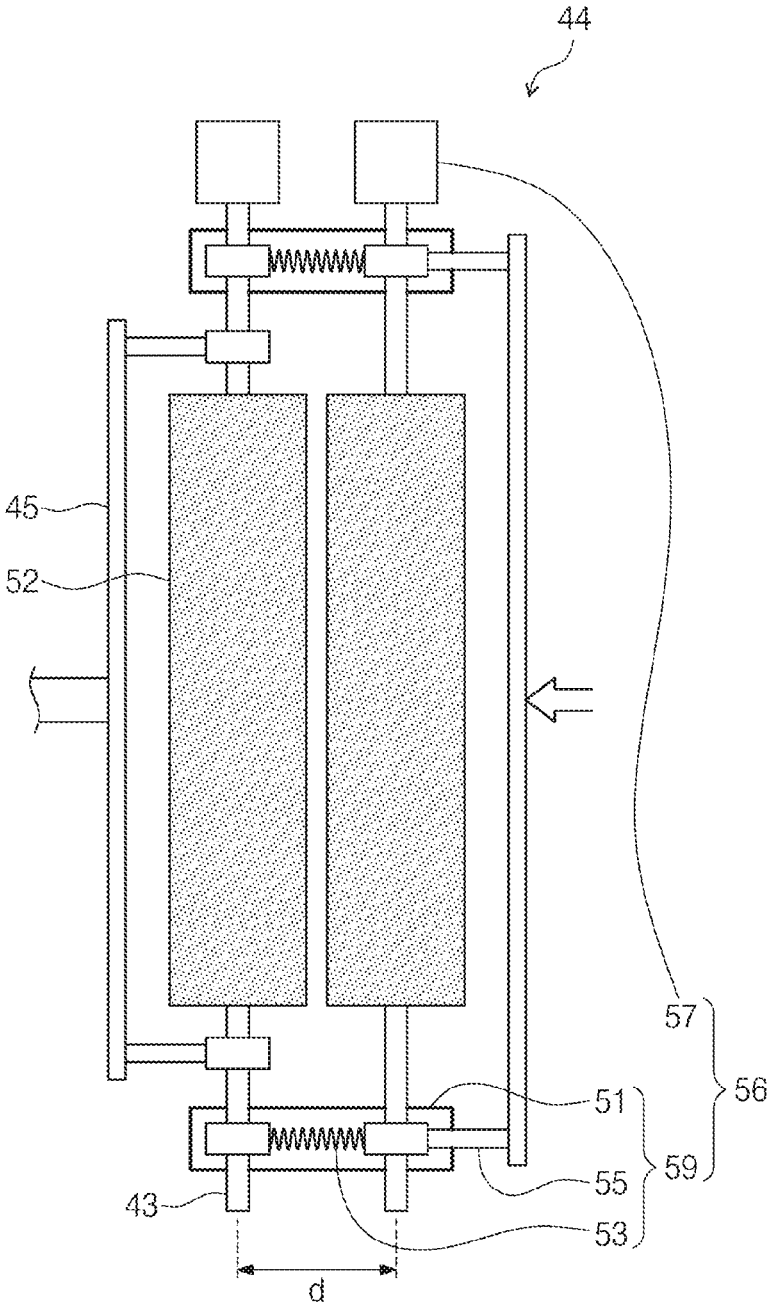
FIG. 3 illustrates a plan view showing an example of a brushing unit shown in FIG. 1.

FIGS. 2 and 3 respectively illustrate perspective and plan views showing an example of the brushing unit 44 shown in FIG. 1.

Referring to FIGS. 2 and 3, the brushing unit 44 may include a pair of roll brushes 52, a roller 54, a driver 56, and a cleaning solution nozzle 58.

The roll brushes 52 may be disposed on the roller 54. During the brushing process, the substrate W may be provided between the pair of roll brushes 52. Each of the roll brushes 52 may have a length greater than a diameter of the substrate W. The roll brushes 52 may each be provided therein with rotating shafts 43. The rotating shafts 43 may rotate the roll brushes 52. Each of the rotating shafts 43 may have a diameter ranging from about 2 mm to about 20 cm. A distance d between the rotating shafts 43 of the roll brushes 52 may fall within a range from at least 4 mm to at most 20 mm. Here, the distance d between the rotating shafts 43 may be defined as a length between outer circumferences of the rotating shafts 43. Alternatively, the distance d between the rotating shafts 43 may be defined as a length between centers of the rotating shafts 43.

Referring to FIG. 2, the roller 54 may support an outer circumference of the substrate W. The roller 54 may rotate the substrate W in an azimuthal direction between the pair of roll brushes 52. The pair of roll brushes 52 may evenly brush top and bottom surfaces of the substrate W.

Referring to FIGS. 2 and 3, the driver 56 may include elements disposed on opposite sides of the pair of roll brushes 52. For example, the driver 56 may include a rotating driver 57 and a distance adjuster 59.

The rotating driver 57 may provide rotational power to the roll brushes 52 and the rotating shafts 43. For example, the rotating driver 57 may include a motor and a gear.

A plurality of distance adjusters 59 may be disposed on opposite sides of the pair of roll brushes 52. Each of the distance adjusters 59 may adjust the distance d between the rotating shafts 43 of the pair of roll brushes 52. For example, each of the distance adjusters 59 may include a housing 51, a spring 53, and a push pin 55.

The housing 51 may be disposed to run across the rotating shafts 43 of the roll brushes 52. In other words, the housing 51 may partially encapsulate the rotating shafts 43. The distance d between the rotating shafts 43 may be adjusted within the housing 51.

The spring 53 may be installed within the housing 51. The spring 53 may be disposed between the rotating shafts 43. The spring 53 may increase the distance d between the rotating shafts 43. That is, the spring 53 may be configured to push the rotating shafts 43 away from each other.

The push pin 55 may push one of the rotating shafts 43 toward a fixing shaft 45, reducing the distance d between the rotating shafts 43. The fixing shaft 45 may rigidly place the remaining rotating shaft 43 in position.

Referring to FIG. 2, the cleaning solution nozzle 58 may be installed on or adjacent to the roll brush 52. The cleaning solution nozzle 58 may provide a cleaning solution 62 onto the substrate W positioned between the pair of roll brushes 52. The cleaning solution 62 may clean both the substrate W and the roll brushes 52.

Referring to FIGS. 1 and 2, the controlling unit 80 may control the polishing module 30 and the cleaning module 40. For example, the controlling unit 80 may include a polishing controller 82 and a cleaning controller 86. The controlling unit 80 may be implemented by hardware or software or any combination thereof. For example, the controlling unit 80 may include a processor.

The polishing controller 82 may control the polishing module 30. For example, the polishing controller 82 may be connected to the first valve 37 and the second valve 39. According to a polishing target layer on the substrate W, the polishing controller 82 may selectively open one of the first and second valves 37 and 39. When the substrate W has a dielectric layer (e.g., silicon oxide or silicon nitride), the first valve 37 may be selectively opened and the first slurry 33*a* may be provided onto the polishing pad 32. The polishing pad 32 may use the first slurry 33*a* to flat polish the dielectric layer on the substrate W. On the other hand, when the substrate W has a metal layer (e.g., Cu), the second valve 39 may be selectively opened and the second slurry 35*a* may be provided onto the polishing pad 32. The polishing pad 32 may use the second slurry 35*a* to flat polish the metal layer on the substrate W.

The cleaning controller 86 may be connected to and may control the cleaning module 40. For example, the cleaning controller 86 may be connected to the driver 56 and the cleaning solution nozzle 58 of the brushing unit 44. The cleaning controller 86 may include, for example, a time calculator 81, a drive controller 83, a slurry determiner 85, and a cleaning solution controller 87.

The time calculator 81 may count a time period when the roll brushes 52 are used. In other words, the time calculator 81 may determine a cumulative usage time of the roll brushes 52. The roll brush 52 may be gradually abraded or polluted over its usage time.

The drive controller 83 may control the driver 56 by using information about the usage time of the roll brushes 52. Based on the usage time of the roll brush 52, the drive controller 83 may adjust the distance d between the rotating shafts 43. For example, based on the usage time of the roll brushes 52, the drive controller 83 may reduce the distance d between the rotating shafts 43 to increase a lifetime of the roll brushes 52.

The slurry determiner 85 may determine whether the first slurry 33*a* or the second slurry 35*a* is provided on the substrate W. For example, the slurry determiner 85 may determine whether the substrate W is provided thereon with the first slurry 33*a* or the second slurry 35*a*, based on whether the first valve 37 or the second valve 39 is opened.

The drive controller 83 may control the driver 56, based on whether the first slurry 33*a* or the second slurry 35*a* is used. For example, based on whether the first slurry 33*a* or the second slurry 35*a* is provided on the substrate W, the drive controller 83 may control a rate of reduction in distance d between the rotating shafts 43 of the pair of roll brushes 52.

The cleaning solution controller 87 may control a supply amount (or flow rate) of the cleaning solution 62 provided to the cleaning solution nozzle 58. For example, based on the usage time of the roll brush 52, the cleaning solution controller 87 may control the supply amount (or flow rate) of the cleaning solution 62.

Figure 4:
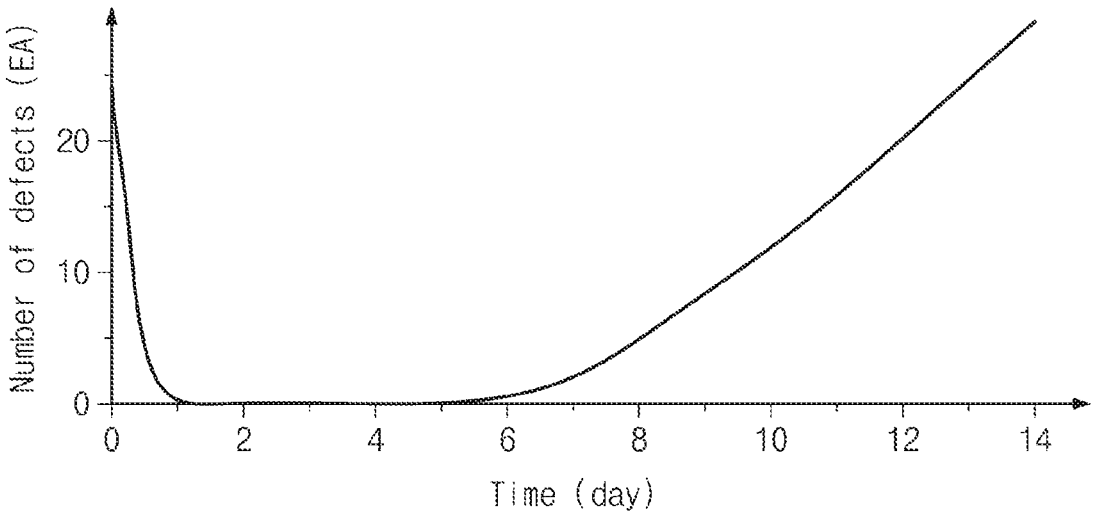
FIG. 4 illustrates a graph showing how the number of defects varies over a time period when a typical brush is used to brush a substrate having a dielectric layer.

FIG. 4 shows how the number of defects varies over a time period when a typical brush is used to brush a substrate having a dielectric layer.

Referring to FIG. 4, a frequency of occurrence of defects may be high at the initial use of a typical brush, then may decrease, and then may increase again after a certain usage time. The typical brush may be contaminated in about one day after its initial use and accordingly may cause defects on a certain substrate. When the typical brushes are held at an invariable distance from each other, abrasion or contamination of the typical brushes may increase in proportion to their usage time and the certain substrate may suffer from increased defects. Additionally, when a slurry (e.g., the first slurry 33*a*) is used to polish a dielectric layer on the certain substrate, the frequency of occurrence of defects may gradually increase during a time period (e.g., about 1 or 2 weeks) after using the typical brushes.

Referring to FIG. 2, the cleaning solution controller 87 may suppress the occurrence of defects by temporarily increasing a flow rate of the cleaning solution 62 at an initial use of the roll brush 52. The cleaning solution controller 87 may provide the cleaning solution nozzle 58 with the cleaning solution 62 of about 20 standard cubic centimeters per minute (SCCM) during one day after using the roll brush 52 and with the cleaning solution 62 of about 10 SCCM during 2 days to 14 days after using the roll brush 52. The cleaning solution 62 may, for example, include a deionized water.

Figure 5:
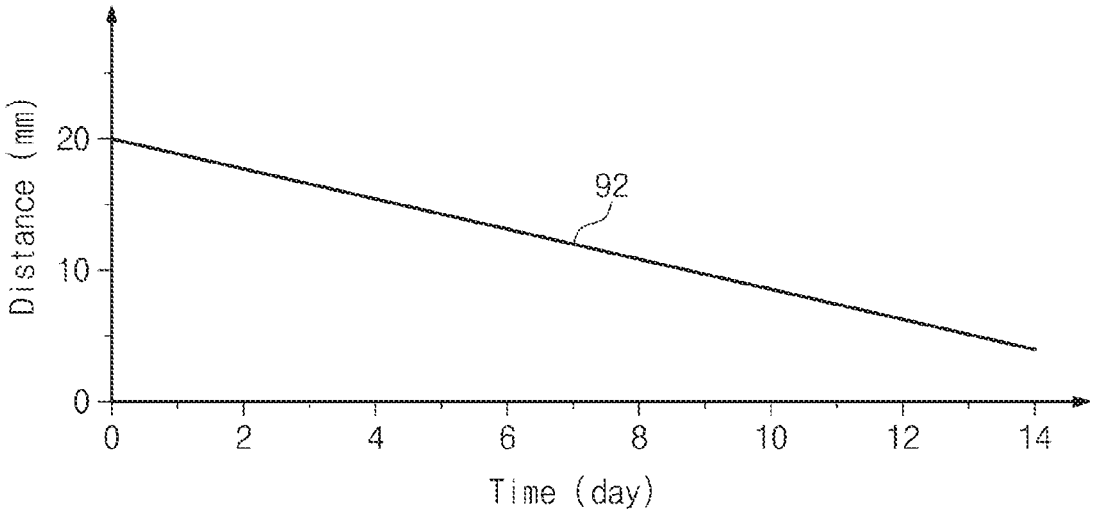
FIG. 5 illustrates a graph showing that a distance between rotating shafts is reduced at a first rate based on a usage time of roll brushes shown in FIG. 2.

FIG. 5 shows that the distance d between rotating shafts 43 is reduced at a first rate 92 based on the usage time of the roll brushes 52 shown in FIG. 2.

Referring to FIGS. 2, 3, and 5, the drive controller 83 and the distance adjuster 59 may suppress the occurrence of defects by gradually reducing the distance d between the rotating shafts 43, based on the usage time of the roll brushes 52. When a dielectric layer on the substrate W is polished by the first slurry 33*a*, the distance d between the rotating shafts 43 may be reduced at the first rate 92. For example, as shown in FIG. 5, the first rate 92 may be about 1 mm/day.

Figure 6:
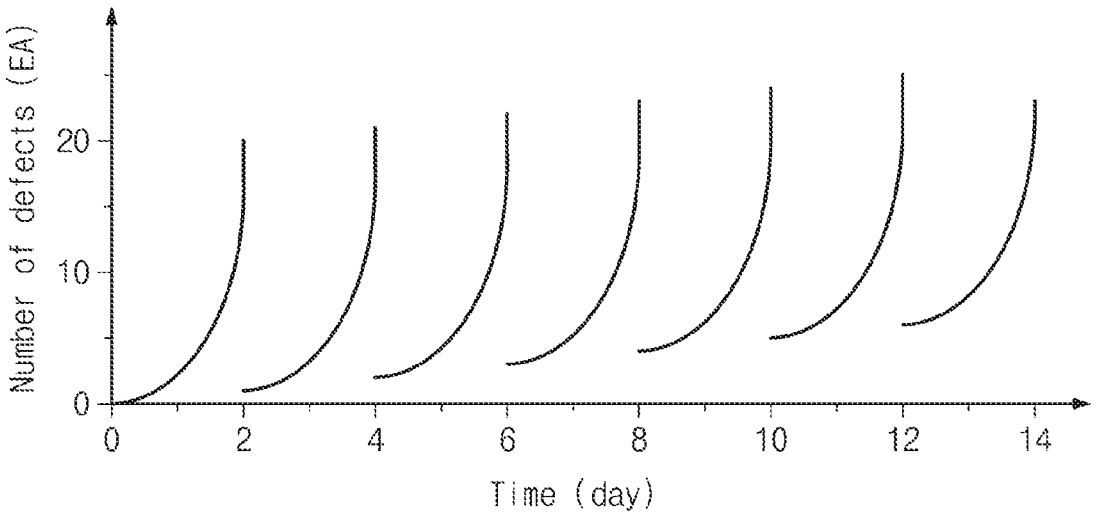
FIG. 6 illustrates a graph showing how often defects occur over a time period when a typical brush is used to brush a substrate having a metal layer.

FIG. 6 shows how often defects occur over a time period when a typical brush is used to brush a substrate having a metal layer.

Referring to FIG. 6, when a slurry (e.g., the second slurry 35*a*) is used to polish a certain substrate, a frequency of occurrence of defect on a typical brush may increase every day. The typical brush may be reused for a time period (e.g., about 1 week) greater than one day, even if it is cleaned daily. Thus, even though the typical brush is periodically cleaned, the frequency of occurrence of defects may gradually increase.

Figure 7:
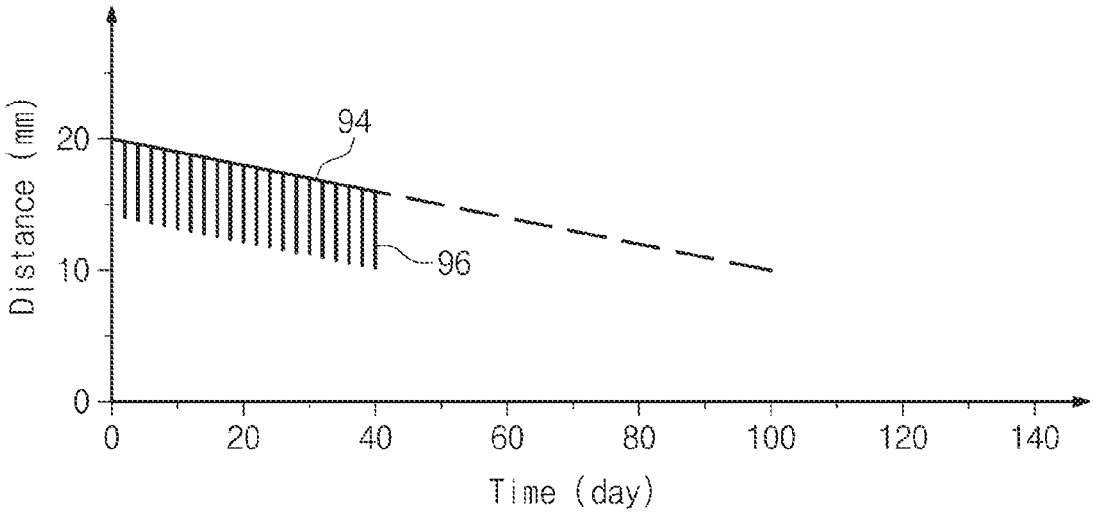
FIG. 7 illustrates a graph showing that a distance between rotating shafts is reduced at a second rate based on a usage time of roll brushes shown in FIG. 2.

FIG. 7 shows that the distance d between rotating shafts 43 is reduced at a second rate 94 based on the usage time of the roll brushes 52 shown in FIG. 2.

Referring to FIG. 7, the drive controller 83 and the distance adjuster 59 may suppress the occurrence of defects by reducing the distance d between the rotating shafts 43 of the roll brushes 52 at the second rate 94, based on the usage time of the roll brushes 52. The second rate 94 may be less than the first rate 92 of FIG. 5. For example, the second rate 94 may be about 0.1 mm/day. In addition, the drive controller 83 may suppress the occurrence of defects by additionally periodically reducing the distance d between the rotating shafts 43, based on the usage time of the roll brushes 52. An additional reduced distance 96 between the rotating shafts 43 may be about 6 mm.

The distance adjuster 59 may move the rotating shafts 43 to the reduced distance 96 of about 6 mm once every predetermined time period (i.e., once every day), and then may return the rotating shafts 43 to their initial position. Whenever the distance d between the rotating shafts 43 is additionally reduced, a bare substrate may be provided between the roll brushes 52. The roll brushes 52 may thus be cleaned by preventative maintenance that uses their compression and the bare substrate.

Referring back to FIG. 1, the measuring module 70 may be installed adjacent to the load station 10. The measuring module 70 may measure the substrate W, acquiring information about defects or polishing thickness of the substrate W. When the substrate W has defects thereon, the first robot arm 22 may transfer the substrate W to the cleaning module 40. When the substrate W lacks in polishing thickness, the first robot arm 22 and the second robot arm 41 may transfer the substrate W to the polishing module 30. When the substrate W is determined as good, the first robot arm 22 may load the substrate W into the carrier 12.

The following will describe a chemical mechanical polishing (CMP) method using the CMP apparatus 100 configured as discussed above.

Figure 8:
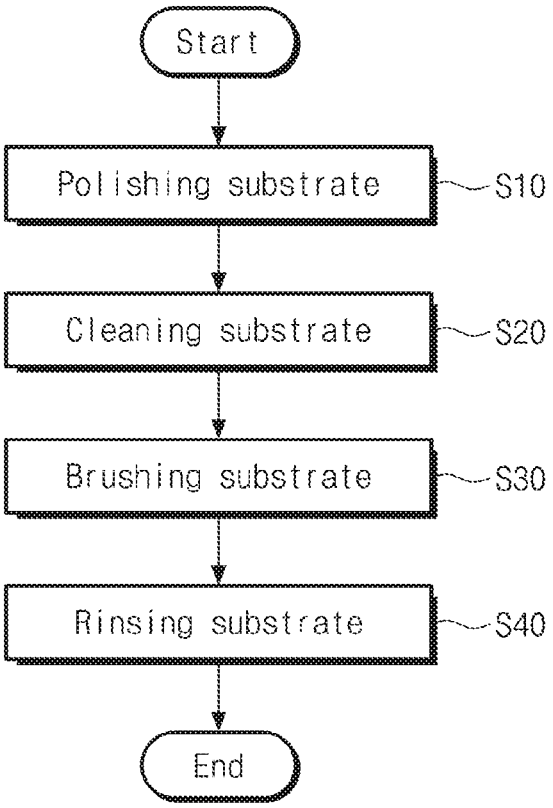
FIG. 8 illustrates a flow chart showing a chemical mechanical polishing method according to an example embodiment.

FIG. 8 illustrates a flow chart showing an example of a chemical mechanical polishing (CMP) method according to an example embodiment.

Referring to FIG. 8, the CMP method of the present disclosure may include polishing the substrate W (S10), cleaning the substrate W (S20), brushing the substrate W (S30), and rinsing the substrate W (S40).

Referring to FIGS. 1 and 8, the polishing module 30 may polish the substrate W (S10). The polishing pad 32 may use the first slurry 33*a* or the second slurry 35*a* to polish the substrate W. When the polishing process is completed on the substrate W, the first robot arm 22 or the second robot arm 41 may transfer the substrate W to the chemical cleaning unit 42 of the cleaning module 40.

The chemical cleaning unit 42 may clean the substrate W (S20). The chemical cleaning unit 42 may immerse the substrate W in a chemical to clean the substrate W. When the cleaning process is completed on the substrate W, the first robot arm 22 may transfer the substrate W to the brushing unit 44.

The brushing unit 44 may brush the substrate W (S30). The brushing unit 44 may use the roll brushes 52 and the cleaning solution 62 to brush the substrate W. For example, the brushing of the substrate W (S30) may include reducing the distance d between the rotating shafts 43, based on the usage time of the roll brushes 52.

Figure 9:
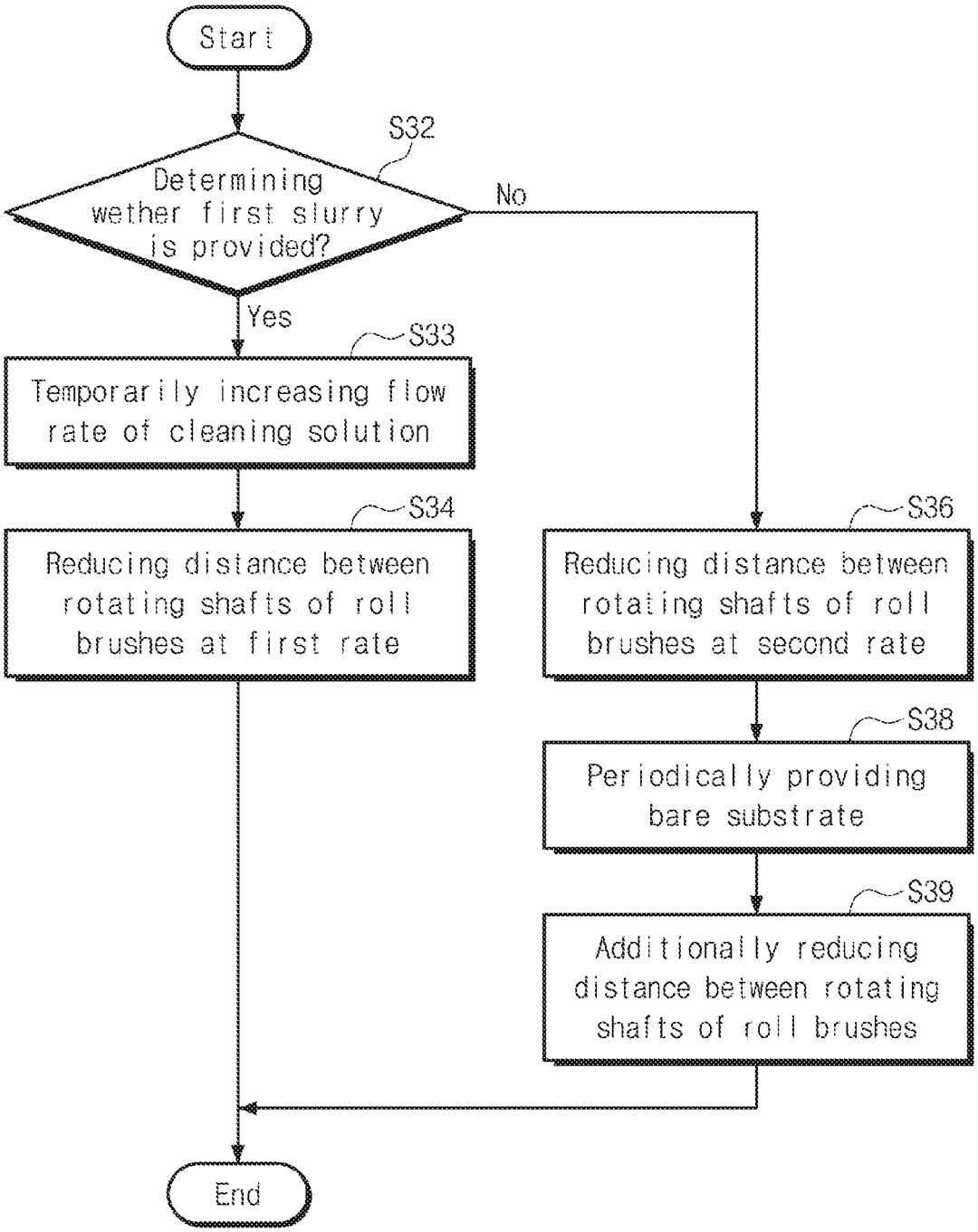
FIG. 9 illustrates a flow chart showing an example of brushing a substrate shown in FIG. 1.

FIG. 9 shows an example of the step S30 of brushing the substrate W of FIG. 1.

Referring to FIGS. 1 and 9, the brushing of the substrate W (S30) may include determining whether the first slurry 33*a* is provided (S32), temporarily increasing a flow rate of the cleaning solution 62 when the first slurry 33*a* is provided (S33), reducing the distance d between the rotating shafts 43 of the roll brushes 52 at the first rate 92 (S34), reducing distance d between the rotating shafts 43 of the roll brushes 52 at the second rate 94 when the second slurry 35*a* is provided (S36), periodically providing a bare substrate (S38), and periodically reducing the distance d between the rotating shafts 43 of the roll brushes 52 (S39) by an additional distance.

The slurry determiner 85 may determine whether the first slurry 33*a* is provided, based on whether the first valve 37 is opened or closed (S32). When the first valve 37 is opened, the slurry determiner 85 may determine that the first slurry 33*a* is provided on the substrate W. When the second valve 39 is opened, the slurry determiner 85 may determine that the second slurry 35*a* is provided on the substrate W.

When it is determined that the first slurry 33*a* is provided on the substrate W, the cleaning solution controller 87 may temporarily increase a flow rate of the cleaning solution 62 at the initial use of the roll brush 52 (S33). At the initial use of the roll brush 52, the cleaning solution controller 87 may suppress or prevent defects by temporarily increasing the flow rate of the cleaning solution 62 to twice the normal flow rate or the like. The cleaning solution controller 87 may also suppress or prevent defects by temporarily increasing the flow rate of the cleaning solution 62 during the first two or more uses of the roll brush 52.

Based on the usage time of the roll brush 52, the drive controller 83 may reduce the distance d between the rotating shafts 43 at the first rate 92 (S34). The drive controller 83 may reduce the distance d between the rotating shafts 43 at the first rate 92 of about 1 mm/day, suppressing or preventing defects caused by an increase in usage time of the roll brush 52.

Based on the usage time of the roll brush 52, the drive controller 83 may reduce the distance d between the rotating shafts 43 at the second rate 94 when it is determined that the second slurry 35*a* is provided on the substrate W (S36). The drive controller 83 may reduce the distance d between the rotating shafts 43 at the second rate 94 of about 0.1 mm/day, suppressing or preventing defects caused by an increase in usage time of the roll brush 52.

The second robot arm 41 of the interface module 20 may periodically provide a bare substrate between a pair of roll brushes 52 every day (S38).

Whenever the bare substrate is provided, the drive controller 83 may clean the roll brushes 52 by reducing the distance d between the rotating shafts 43 (S39) by an additional distance. The rotating shafts 43 may be moved the reduced distance 96 (i.e., the additional distance) of about 6 mm every day, and then may return to their initial position. While the roll brushes 52 are positioned at the reduced distance, the roll brushes 52 may compress each other. The roll brushes 52 may be cleaned due to their compression and the presence of the bare substrate therebetween. When the brushing process is completed on the substrate W, the first robot arm 22 may transfer the substrate W to the rinsing unit 46.

The rinsing unit 46 may rinse the substrate W (S40). For example, the rinsing unit 46 may provide the substrate W with a deionized water to rinse the substrate W. The rinsed substrate W may be dried. The first robot arm 22 may load the substrate W into the carrier 12.

In a chemical mechanical polishing apparatus according to the present disclosure, a distance between roll brushes may be reduced based on a usage time of the roll brushes, with the result that the roll brushes may increase in lifetime and minimize in defects.

Although example embodiments have been described in connection with the accompanying drawings, it will be understood to those skilled in the art that various changes and modifications may be made without departing from the technical spirit and essential feature of the present disclosure. It therefore will be understood that example embodiments described above are just illustrative but not limiting in all aspects.

What is claimed is:

1. A chemical mechanical polishing (CMP) apparatus comprising:

a polishing pad configured to polish a substrate;

a slurry nozzle located on the polishing pad;

a slurry supply configured to provide the polishing pad with a first slurry or a second slurry through the slurry nozzle;

a cleaning unit configured to clean the substrate;

a brushing unit comprising a plurality of roll brushes configured to brush the substrate and a driver configured to drive the plurality of roll brushes, each of the plurality of roll brushes being provided with a rotating shaft; and a controlling unit configured to control the driver, wherein the controlling unit is further configured to count a usage time of the plurality of roll brushes and to reduce a distance between the rotating shafts of the plurality of roll brushes based on the counted usage time, wherein the controlling unit is further configured to control the distance between the rotating shafts of the plurality of roll brushes at a decreasing rate of 0.1 mm/day to 1 mm/day, and wherein the controlling unit is further configured to reduce the distance between the rotating shafts of the plurality of roll brushes at a first rate in response to the first slurry being provided and at a second rate in response to the second slurry being provided.

2. The CMP apparatus of claim 1, wherein the brushing unit further comprises a cleaning solution nozzle configured to provide a cleaning solution between the plurality of roll brushes, and wherein the controlling unit is further configured to temporarily increase a flow rate of the cleaning solution at an initial use of the plurality of roll brushes.

3. The CMP apparatus of claim 1, wherein the first slurry includes silica, wherein the second slurry includes hydrogen peroxide, and wherein the first rate is greater than the second rate.

4. The CMP apparatus of claim 3, wherein the first rate is 1 mm/day.

5. The CMP apparatus of claim 3, wherein the second rate is 0.1 mm/day.

6. The CMP apparatus of claim 3, wherein the controlling unit is further configured to compress the plurality of roll brushes by periodically reducing the distance between the rotating shafts of the plurality of roll brushes by an additional distance and subsequently increasing the distance between the rotating shafts of the plurality of roll brushes by the additional distance.

7. The CMP apparatus of claim 6, wherein the plurality of roll brushes are compressed once every predetermined time period, and the additional distance is 6 mm.

8. The CMP apparatus of claim 1, wherein the slurry supply comprises:

a first slurry tank configured to store the first slurry;

a second slurry tank configured to store the second slurry;

a first valve located between the first slurry tank and the slurry nozzle configured to be selectively opened; and a second valve located between the second slurry tank and the slurry nozzle configured to be selectively opened, wherein the controlling unit is further configured to reduce the distance between the rotating shafts of the plurality of roll brushes at the first rate when the first valve is opened, and wherein the controlling unit is further configured to reduce the distance between the rotating shafts of the plurality of roll brushes at the second rate when the second valve is opened.

9. The CMP apparatus of claim 1, wherein the driver comprises:

a spring configured to push the rotating shafts of the plurality of roll brushes away from each other; and a push pin configured to push one of the plurality of roll brushes to reduce the distance between the rotating shafts of the plurality of roll brushes.

10. A chemical mechanical polishing (CMP) apparatus comprising:

a load station accommodating a carrier, the carrier being configured to store a substrate;

a polishing module configured to provide a first slurry or a second slurry to polish the substrate;

a cleaning module comprising a plurality of roll brushes configured to brush the first slurry or the second slurry remaining on the polished substrate, each of the plurality of roll brushes being provided with a rotating shaft; and a controlling unit configured to determine whether to supply the first slurry or the second slurry based on a polishing target on the substrate and to determine a rate of reduction in distance between the rotating shafts of the plurality of roll brushes based on the determination whether to supply the first slurry or the second slurry.

11. The CMP apparatus of claim 10, wherein the controlling unit is further configured to reduce the distance between the rotating shafts of the plurality of roll brushes at a first rate when the first slurry is provided on the substrate, and wherein the controlling unit is further configured to reduce the distance between the rotating shafts of the plurality of roll brushes at a second rate less than the first rate when the second slurry is provided on the substrate.

12. The CMP apparatus of claim 11, wherein the first rate is 1 mm/day, and the second rate is 0.1 mm/day.

13. The CMP apparatus of claim 11, wherein the cleaning module further comprises a driver configured to adjust the distance between the rotating shafts of the plurality of roll brushes, wherein the controlling unit is further configured to count a usage time of the plurality of roll brushes and to control the driver to reduce the distance between the rotating shafts of the plurality of roll brushes at the first rate or the second rate based on the counted usage time.

14. The CMP apparatus of claim 13, further comprising a first valve configured to be selectively opened to supply the first slurry and a second valve configured to be selectively opened to supply the second slurry, wherein the controlling unit is further configured to determine whether the first slurry or the second slurry is provided on the substrate based on whether the first valve or the second valve is opened.

15. A chemical mechanical polishing (CMP) method, comprising:

polishing a substrate with a first slurry or a second slurry;

cleaning the substrate;

brushing the substrate with a plurality of roll brushes, each of the plurality of roll brushes being provided with a rotating shaft; and rinsing the substrate, wherein the brushing the substrate comprises reducing a distance between the rotating shafts of the plurality of roll brushes at a decreasing rate of 0.1 mm/day to 1 mm/day based on a usage time of the plurality of roll brushes, and wherein the brushing the substrate further comprises reducing the distance between the rotating shafts of the plurality of roll brushes at a first rate in response to the first slurry being provided and at a second rate in response to the second slurry being provided.

16. The CMP method of claim 15, wherein the first slurry includes silica or ceria.

17. The CMP method of claim 16, wherein the second slurry includes hydrogen peroxide.

18. The CMP method of claim 17, further comprising:

periodically providing a bare substrate between the plurality of roll brushes when it is determined that the second slurry is provided; and reducing the distance between the rotating shafts of the plurality of roll brushes by an additional distance whenever the bare substrate is provided and subsequently increasing the distance between the rotating shafts of the plurality of roll brushes by the additional distance.

19. The CMP method of claim 15, further comprising:

determining whether the second slurry is provided on the substrate; and temporarily increasing a flow rate of a cleaning solution provided between the plurality of roll brushes at an initial use of the plurality of roll brushes when it is determined that the second slurry is provided.

* * * * *